US010369796B2

(12) United States Patent
Fujikawa

(10) Patent No.: US 10,369,796 B2
(45) Date of Patent: Aug. 6, 2019

(54) PRINTING APPARATUS AND PERFORMANCE MAINTAINING METHOD

(71) Applicant: CANON KABUSHIKI KAISHA, Tokyo (JP)

(72) Inventor: Muneharu Fujikawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/657,532

(22) Filed: Jul. 24, 2017

(65) Prior Publication Data

US 2018/0029370 A1 Feb. 1, 2018

(30) Foreign Application Priority Data

Aug. 1, 2016 (JP) ..... 2016-151523

(51) Int. Cl.
*B41J 2/165* (2006.01)
*B41J 2/21* (2006.01)
*B41J 2/045* (2006.01)

(52) U.S. Cl.
CPC ..... *B41J 2/16511* (2013.01); *B41J 2/16508* (2013.01); *B41J 2/16523* (2013.01); *B41J 2/16526* (2013.01); *B41J 2/16532* (2013.01); *B41J 2/16538* (2013.01); *B41J 2/16544* (2013.01); *B41J 2/2114* (2013.01); *B41J 2/04505* (2013.01); *B41J 2002/1657* (2013.01); *B41J 2002/16514* (2013.01)

(58) Field of Classification Search
CPC ..... B41J 2/16511; B41J 2/16505
See application file for complete search history.

(56) References Cited

U.S. PATENT DOCUMENTS

2004/0104961 A1 6/2004 Hashi et al.
2004/0196327 A1 10/2004 Nishioka
2005/0151781 A1* 7/2005 Oku ..... B41J 2/16535 347/33
2007/0046721 A1 3/2007 Miyazawa
2007/0085875 A1 4/2007 Shimazaki et al.
2008/0238983 A1* 10/2008 Takahashi ..... B41J 2/16511 347/23

(Continued)

FOREIGN PATENT DOCUMENTS

JP 2007-160616 A 6/2007

OTHER PUBLICATIONS

Dec. 27, 2017 European Search Report in co-pending European Patent Application No. 17001256.1.

*Primary Examiner* — Shelby L Fidler
(74) *Attorney, Agent, or Firm* — Veneble LLP

(57) ABSTRACT

A printing apparatus includes: a printhead configured to discharge ink; a carriage, on which the printhead is mounted, configured to move in a first direction such that the printhead moves across a printing region where a printing operation by the printhead is performed and a standby region adjacent to the printing region; a cap arranged in the standby region and configured to suck the ink from the printhead; and a wiper configured to perform wiping for the printhead. The cap can be displaced to a first position and a second position farther from the printing region in the first direction than the first position. At the second position, the cap can be displaced to an upper position to cap the printhead and a lower position to be separated from the printhead allowing the wiper to wipe the printhead.

11 Claims, 13 Drawing Sheets

(56) References Cited

U.S. PATENT DOCUMENTS

| | | | | |
|---|---|---|---|---|
| 2009/0096830 | A1* | 4/2009 | Shimazaki | B41J 2/16511 347/30 |
| 2009/0102884 | A1* | 4/2009 | Kawakami | B41J 2/16511 347/32 |
| 2012/0050396 | A1* | 3/2012 | Yoshino | B41J 2/16511 347/29 |
| 2015/0042720 | A1 | 2/2015 | Tosaka | |
| 2015/0246535 | A1* | 9/2015 | Kobashi | B41J 2/16508 347/44 |

* cited by examiner

PRINTING APPARATUS AND PERFORMANCE MAINTAINING METHOD

BACKGROUND OF THE INVENTION

Field of the Invention

The present invention relates to a printing apparatus represented by an inkjet printing apparatus.

Description of the Related Art

As a method of maintaining the ink discharge performance of a printhead, preliminary discharge or printhead cleaning is known. As the printhead cleaning, for example, negative pressure suction by a cap or wiping by a wiper is known. To decrease the number of parts and reduce the size of the apparatus, there has been proposed a printing apparatus that performs preliminary discharge to the cap, thereby using a single cap for both cleaning and preliminary discharge (for example, Japanese Patent Laid-Open No. 2007-160616).

When using a cap for both cleaning and preliminary discharge, the arrangement of the cap is a problem. As for the cleaning of the cap, it may be advantageous to place the cap and the wiper at a position far from a printing medium such as paper from the viewpoint of capping release after negative pressure suction or ink scattering caused by wiping. On the other hand, preliminary discharge is performed during printing of an image on a printing medium such as paper. If the moving distance of the printhead up to the cap is long, throughput lowers. Japanese Patent Laid-Open No. 2007-160616 proposes an arrangement capable of improving the throughput by arranging not the wiper but the cap closer to the printing medium. However, it is essential to move the printhead to the position of the cap and wiper at the time of cleaning. This increases the cleaning time.

SUMMARY OF THE INVENTION

The present invention provides a technique capable of suppressing a decrease in throughput when using a cap for both preliminary discharge and cleaning.

According to an aspect of the present invention, there is provided a printing apparatus comprising: a printhead configured to discharge ink; a carriage, on which the printhead is mounted, configured to move in a first direction such that the printhead moves across a printing region where a printing operation by the printhead is performed and a standby region adjacent to the printing region; a cap arranged in the standby region and configured to suck the ink from the printhead; and a wiper configured to perform wiping for the printhead, wherein the cap can be displaced to a first position and a second position farther from the printing region in the first direction than the first position, and wherein, at the second position, the cap can be displaced to an upper position to cap the printhead and a lower position to be separated from the printhead allowing the wiper to wipe the printhead.

Further features of the present invention will become apparent from the following description of exemplary embodiments (with reference to the attached drawings).

DESCRIPTION OF THE EMBODIMENTS

<Overall Arrangement>

Figure 1A:
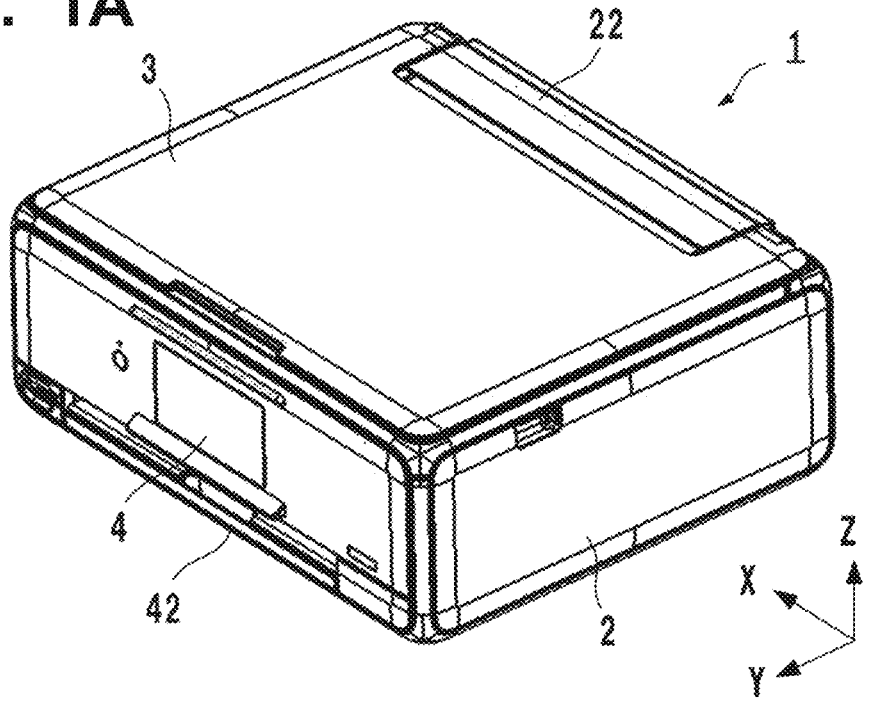
FIG. 1A is a perspective view showing the outer appearance of a printing apparatus according to an embodiment of the present invention.
Figure 1B:
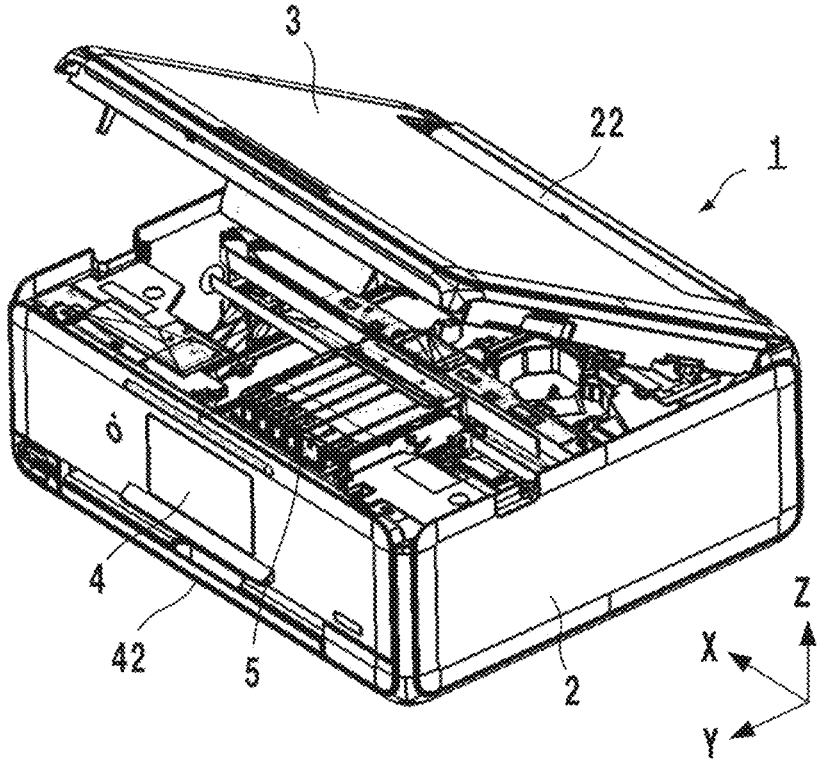
FIG. 1B is a perspective view showing the outer appearance of the printing apparatus in an open state.

FIG. 1A is a perspective view showing the outer appearance of a printing apparatus 1 according to an embodiment of the present invention. The printing apparatus 1 has a rectangular parallelepiped shape as a whole. A scanner unit 3 is provided on a main body 2 to be capable of opening/closing. A display device 4 of touch panel type configured to receive a user operation is provided on the front surface of the main body 2. FIG. 1B shows a state in which the scanner unit 3 is opened, illustrating a form when exchanging a plurality of types of ink tanks 5 detachably incorporated in the printing apparatus 1. In FIGS. 1A and 1B, arrows X, Y, and Z indicate the widthwise direction, the depth direction, and the height direction of the printing apparatus 1, respectively, which are directions crossing each other (here, directions orthogonal to each other). This also applies to the arrows X, Y, and Z in other drawings.

The printing apparatus 1 is a serial inkjet printing apparatus that prints an image by discharging inks supplied from the ink tanks 5 to a printing medium. Note that "print" includes not only formation of significant information such as a character or graphic pattern but also formation of an image, design, or pattern on print media in a broader sense or processing of print media regardless of whether the information is significant or insignificant or has become obvious to allow human visual perception. In this embodiment, "print media" are assumed to be paper sheets but may be fabrics, plastic films, and the like.

Figure 2B:
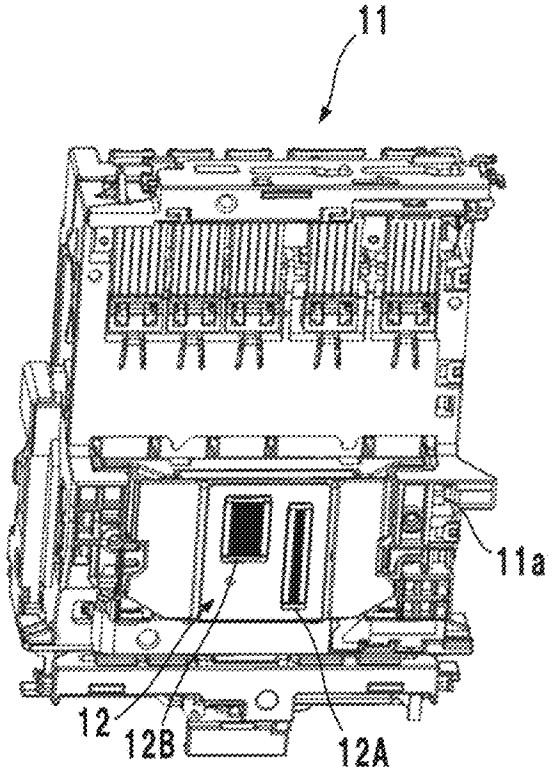
FIG. 2B is a perspective view showing the bottom surface side of a carriage.
Figure 2A:
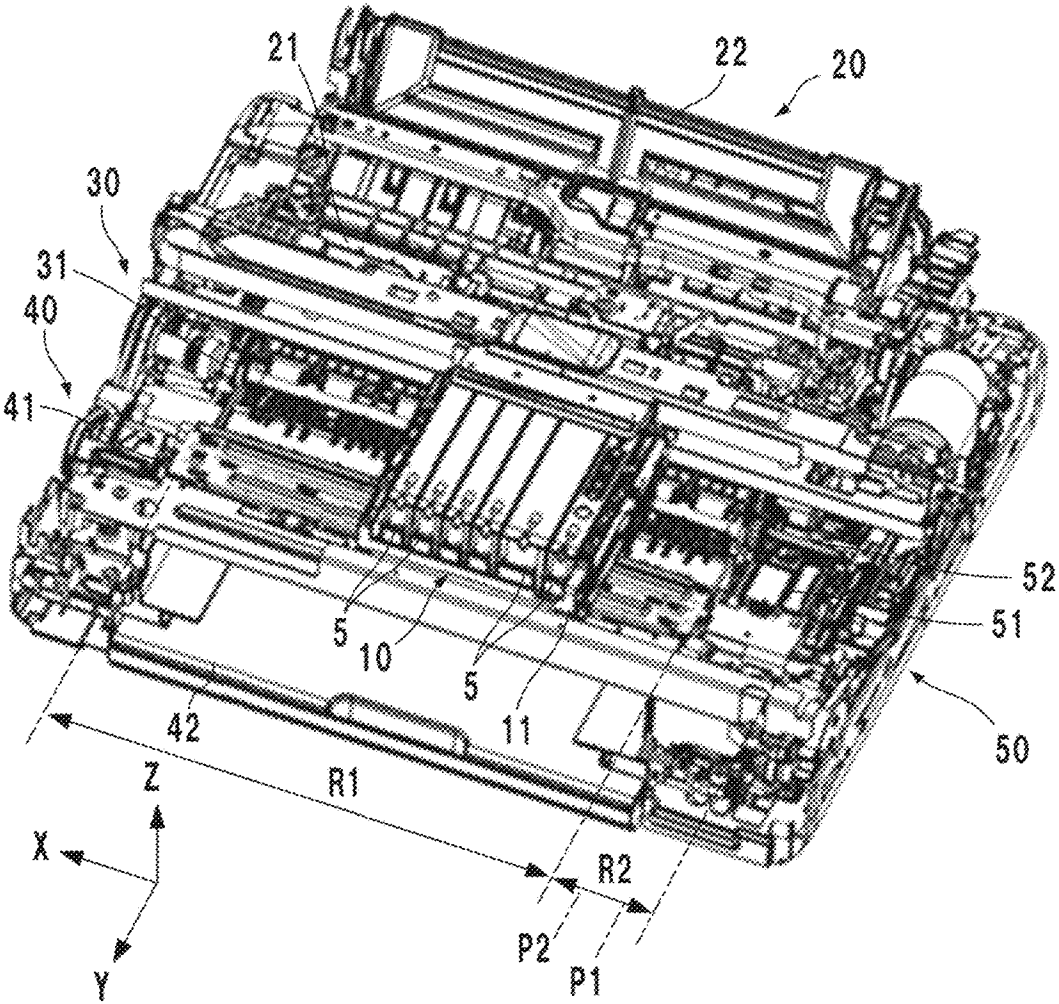
FIG. 2A is a perspective view showing the internal mechanism of the printing apparatus shown in FIG. 1A.

FIG. 2A is a perspective view showing the internal mechanism of the printing apparatus 1. The printing apparatus 1 includes a printing unit 10, a feeding unit 20, a conveying unit 30, a discharge unit 40, and a maintenance unit (recovery unit) 50.

The feeding unit 20, the conveying unit 30, and the discharge unit 40 are mechanisms configured to convey a printing medium. The conveyance direction will be referred to as a sub-scanning direction, and the conveyance source will sometimes be referred to as an upstream side, and the conveyance destination as a downstream side. In this embodiment, the sub-scanning direction is the Y direction in the planar view of the printing apparatus 1.

The feeding unit 20 includes a feeding roller 21 extending in the X direction. The feeding roller 21 is rotated by the driving force of a driving source (in this embodiment, a motor) (not shown) and can convey a printing medium stacked on a stack table 22. The stack table 22 is arranged on the rear side of the main body 2, and can be expanded from a retracted state shown in FIG. 1A to an expanded state shown in FIG. 2A.

The conveying unit 30 is arranged on the downstream side of the feeding unit 20 in the conveyance direction. The conveying unit 30 includes a conveying roller 31 extending in the X direction. The conveying roller 31 is rotated by the driving force of a driving source (in this embodiment, a motor) (not shown) and conveys the printing medium conveyed from the feeding unit 20. A driven roller is pressed against the conveying roller 31. The printing medium is conveyed while being sandwiched by the nip portion between the conveying roller 31 and the driven roller.

The discharge unit 40 is arranged on the downstream side of the conveying unit 30 in the conveyance direction. The discharge unit 40 includes a discharge roller 41 extending in the X direction. The discharge roller 41 is rotated by the driving force of a driving source (in this embodiment, a motor) (not shown) and conveys the printing medium conveyed from the conveying unit 30 onto a discharge table 42. The discharge table 42 is arranged in the bottom portion of the main body 2, and can be drawn from a retracted state shown in FIG. 1A to an expanded state.

The printing unit 10 is a mechanism configured to print an image on a printing medium. The printing unit 10 includes a carriage 11. The plurality of types of ink tanks 5 are detachably mounted on the carriage 11. As shown in FIG. 2B, a printhead 12 is mounted in the carriage 11. The printhead 12 can be either detachable or fixed to the carriage 11.

The printhead 12 is arranged in the bottom portion of the carriage 11. The printhead 12 includes a plurality of orifices to discharge ink. The printhead 12 discharges ink supplied from the ink tanks 5 to the printing medium conveyed by the conveying unit 30, thereby printing an image. In this embodiment, the printhead 12 includes a printhead 12A and a printhead 12B which are arranged in the X direction. The printheads 12A and 12B discharge different types of inks. The printhead 12A discharges, for example, black pigment ink. The printhead 12B discharges, for example, color dye inks. A surface where ink orifices are formed will sometimes be referred to as an ink discharge surface. In this embodiment, the lower surface of each of the printheads 12A and 12B is the ink discharge surface.

The printing unit 10 includes a driving mechanism that reciprocally moves the carriage 11 in a predetermined direction. The reciprocal moving direction of the carriage 11 will be referred to as a main scanning direction that is the X direction in this embodiment. The movement of the carriage 11 will be referred to as scanning. Printing an image by the printhead 12 while moving the carriage 11 will be referred to as print scanning in some cases.

The driving mechanism of the carriage 11 includes, for example, a guiderail that guides the movement of the carriage 11 in the main scanning direction, and a belt transmission mechanism that transmits the driving force from a driving source (in this embodiment, a motor) to the carriage 11 and moves it in the main scanning direction.

The maintenance unit 50 is a mechanism configured to maintain and recover the ink discharge performance of the printhead 12. The maintenance unit 50 includes a cap 51 and a wiper 52. In this embodiment, preliminary discharge and cleaning can be performed as the maintenance/recovery of the ink discharge performance of the printhead 12. In this embodiment, preliminary discharge is an operation of discharging ink from the printhead 12 to the cap 51. In this embodiment, cleaning includes an operation of capping the printhead 12 with the cap 51 and sucking ink from the printhead 12 and an operation (wiping) of wiping the ink discharge surface of the printhead 12 by the wiper 52.

The maintenance unit 50 is arranged at one end of the main body 2 in the X direction. When the carriage 11 moves, the printhead 12 moves across a printing region R1 and a standby region R2 adjacent to the printing region R1 in the main scanning direction. The maintenance unit 50 is arranged in the standby region R2. The printing region R1 is a region where the printhead 12 moves to print an image on the printing medium, and is a region corresponding to the conveyance path of the printing medium. The standby region R2 is a region outside the conveyance path of the printing medium, and is a region where the printhead 12 is located when intending to stand by for next printing.

In this embodiment, two positions, that is, a position P1 and a position P2 are set as the stop positions of the printhead 12 in the standby region. The position P1 is a cleaning position at which cleaning of the printhead 12 is performed. The position P1 is the initial position (home position) of the printhead 12 according to this embodiment. The position P2 is a preliminary discharge position at which preliminary discharge of the printhead 12 is performed. The position P2 is set to be closer to the printing region R1 in the main scanning direction than the position P1.

Image printing on the printing medium by the printing apparatus 1 can be performed, for example, in the following way. The printing medium fed from the feeding unit 20 is intermittently conveyed by the conveying unit 30, and printing medium conveyance and image printing by the printing unit 10 are alternately performed. More specifically, the printing medium is conveyed by the conveying unit 30 to a row position (a position in the sub-scanning direction) where an image is formed and stops. During the stop of conveyance of the printing medium, the carriage 11 is moved to perform print scanning. Next, the conveying unit 30 conveys the printing medium to the next row position, and the same procedure as described above is repeated. The image can thus be printed on the entire surface of the printing medium. When the image printing ends, the printing medium is discharged by the discharge unit 40.

Preliminary discharge of the printhead 12 can be done by moving the printhead 12 to the position P2 after print scanning is performed one or a plurality of times. Cleaning of the printhead 12 can be done at the start of print job execution or between pages.

<Maintenance Unit>

Figure 3:
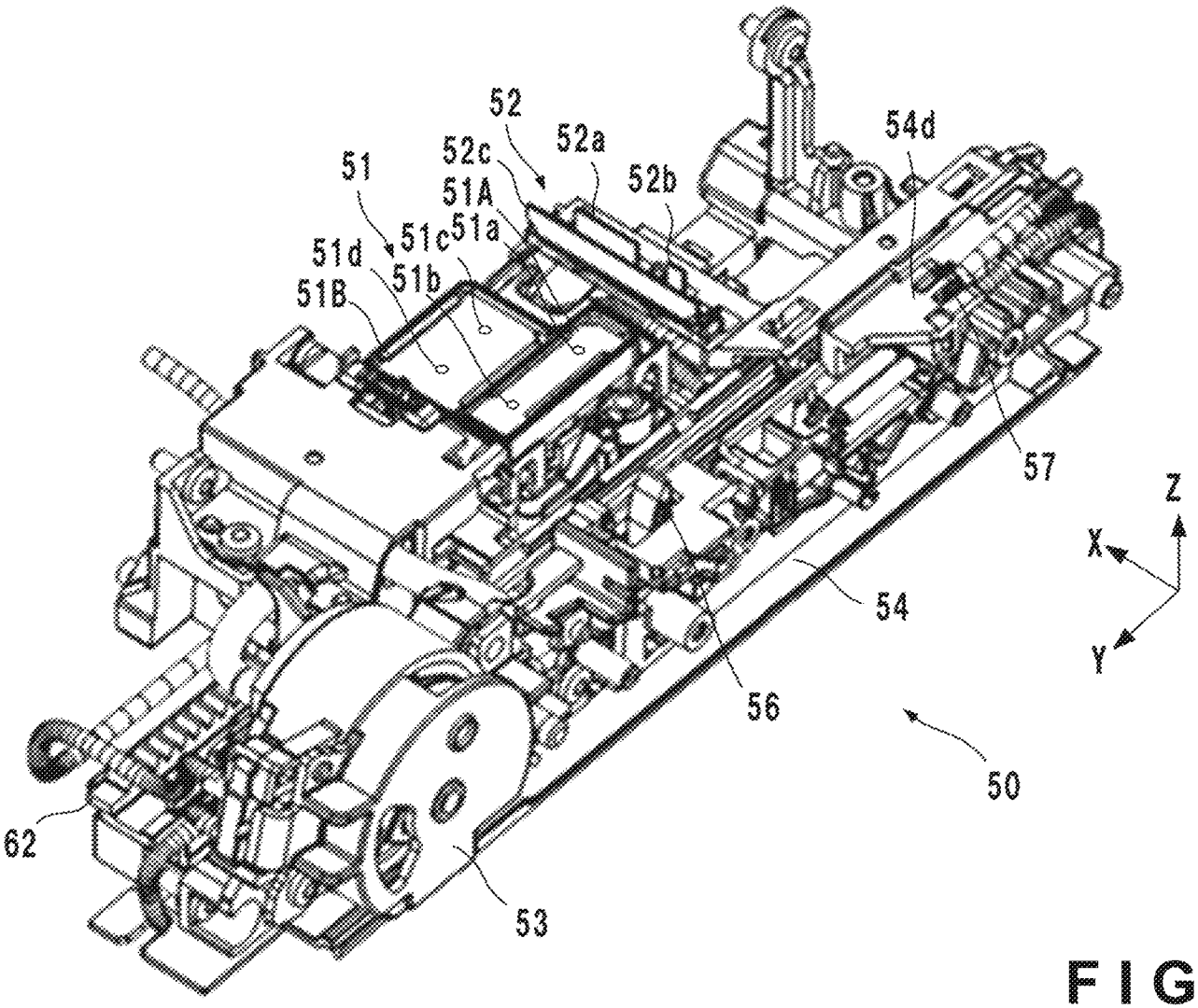
FIG. 3 is a perspective view of a maintenance unit.
Figure 4:
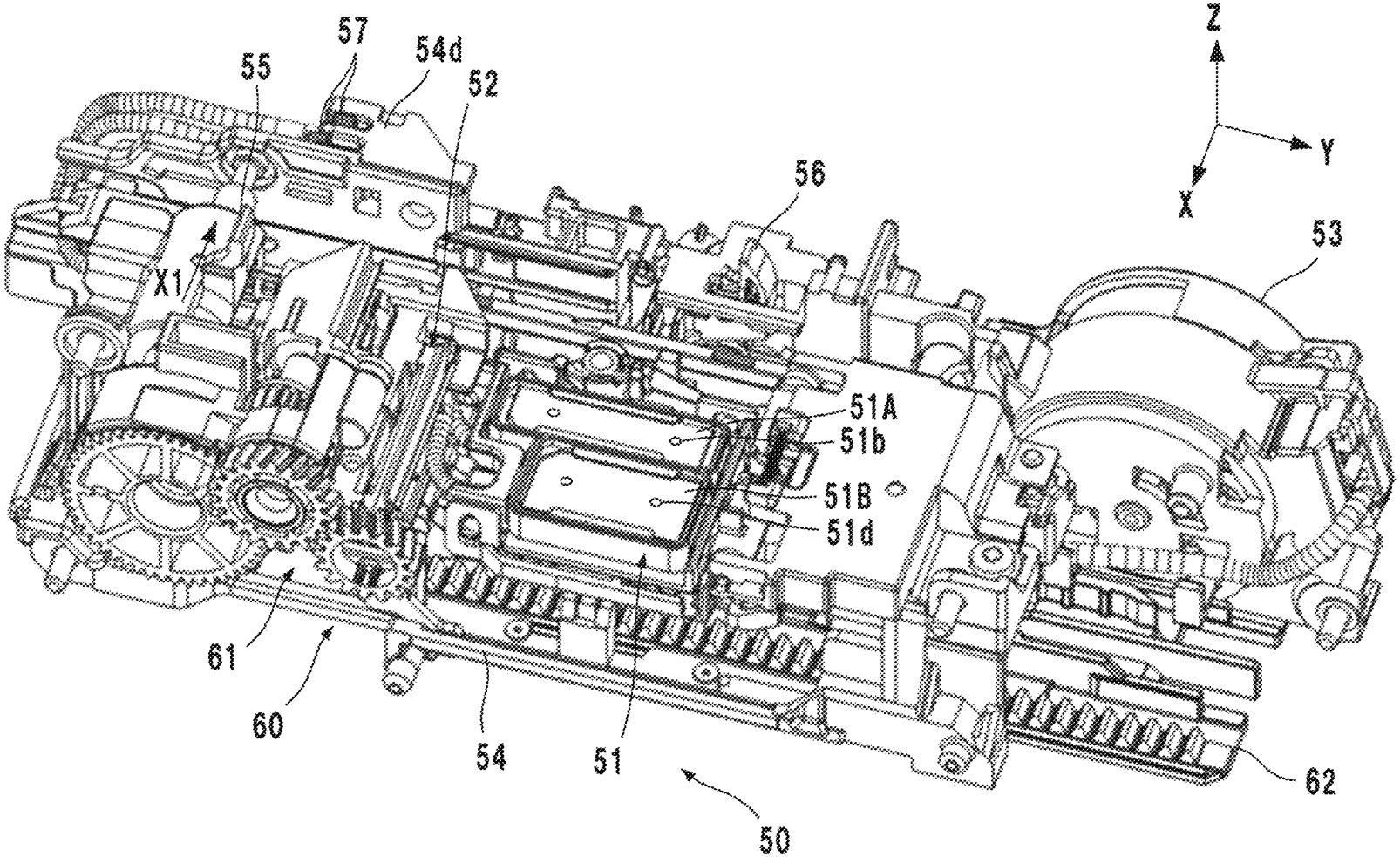
FIG. 4 is a perspective view of the maintenance unit.

The arrangement of the maintenance unit 50 will be described with reference to FIGS. 3 and 4. FIGS. 3 and 4 are perspective views showing the arrangement of part of the maintenance unit 50.

The maintenance unit 50 includes a base member 54, and components are supported by the base member 54. The base member 54 is a frame integrally formed as a whole by, for example, a resin material.

The maintenance unit 50 includes the cap 51 that sucks ink from the printhead 12. In this embodiment, the cap 51 includes a cap 51A corresponding to the printhead 12A, and a cap 51B corresponding to the printhead 12B.

The cap 51A is a cup-shaped member capable of hermetically covering the ink discharge surface of the printhead 12A, and is made of, for example, a flexible material such as rubber. An opening portion 51*a* and an opening portion 51*b* are formed in the cap 51A. The opening portion 51*a* is a hole for atmosphere communication, and the opening portion 51*b* is a hole for negative pressure suction of ink.

The cap 51B is a cup-shaped member capable of hermetically covering the ink discharge surface of the printhead 12B, and is made of, for example, a flexible material such as rubber. An opening portion 51*c* and an opening portion 51*d* are formed in the cap 51B. The opening portion 51*c* is a hole for atmosphere communication, and the opening portion 51*d* is a hole for ink suction. The opening portions 51*b* and 51*d* are connected to a pump 53 via flexible tubes. By driving the pump 53, ink in the printheads 12A and 12B can be sucked from the opening portions 51*b* and 51*d* by negative pressure.

The maintenance unit 50 includes the wiper 52. In this embodiment, the wiper 52 includes a wiper 52*a* corresponding to the printhead 12A, a wiper 52*b* corresponding to the printhead 12B, and a wiper 52*c* corresponding to the whole of the printheads 12A and 12B. Each of the wipers 52*a* to 52*c* is a blade-shaped member that moves in the Y direction and wipes the ink discharge surface of the printhead 12 located at the position P1, and is made of, for example, a flexible material such as rubber.

The maintenance unit 50 includes a switching member 55, a lock lever 56, an air valve lever 57, and a unit driving mechanism 60. The switching member 55 is a movable member configured to switch the transmission of a driving force to the maintenance unit 50, and is provided to be movable in the X direction. When the carriage 11 moves from the printing region R1 to the position P1, the carriage 11 abuts against the switching member 55. When the switching member 55 moves by a predetermined amount in a direction (outward in the X direction) indicated by an arrow X1 in FIG. 4 along with the movement of the carriage 11 and stops, the driving force can be transmitted.

Figure 11A:
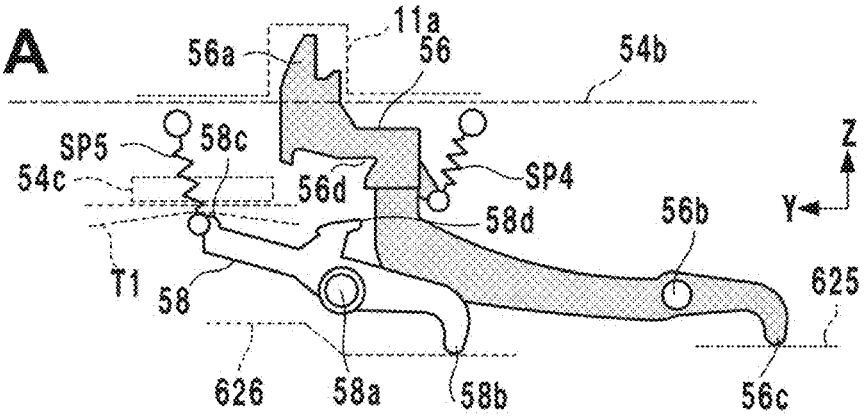
FIGS. 11A to 11D are explanatory views of a carriage lock mechanism and a charge mechanism.
Figure 11B:
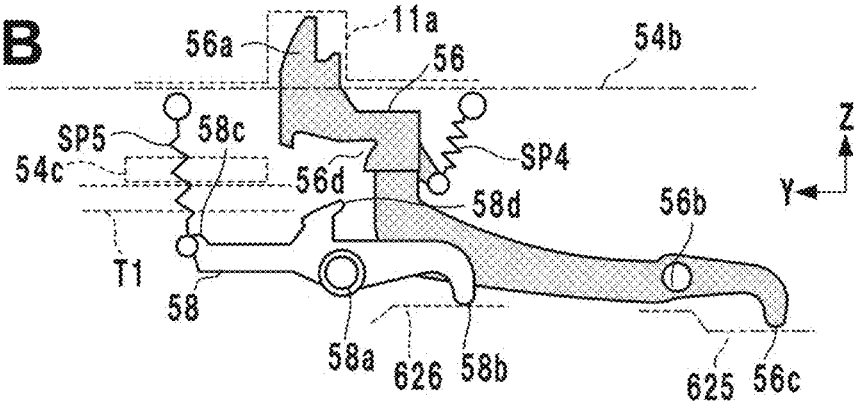
Figure 11C:
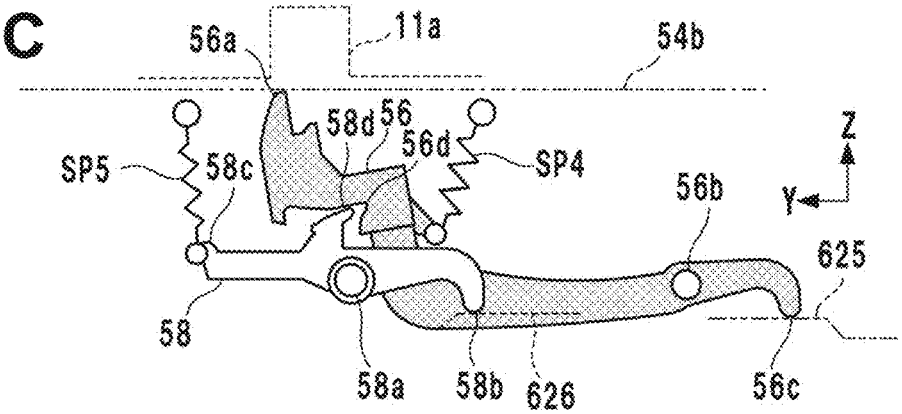

The lock lever 56 is a movable member that positions and locks the carriage 11 at the position P1 in the standby region R2. The lock lever 56 engages with an engaging hole 11*a* (see FIG. 2B) provided in the bottom portion of the carriage 11, thereby locking the carriage 11 at the position P1. A charge lever 58 shown in FIGS. 11A to 11C is disposed near the lock lever 56. Details of these members will be described later.

The air valve lever 57 is a movable member provided in correspondence with the opening portions 51*a* and 51*c* and configured to close/release flexible tubes for atmosphere communication connected to the opening portions 51*a* and 51*c*. The air valve lever 57 forms an air valve. The caps 51A and 51B can thus be switched between a state in which the interior communicates with the atmosphere and a state in which the interior does not communicate with the atmosphere. Details will be described later.

The driving force from the driving source of the maintenance unit 50 is input to the unit driving mechanism 60. The driving source may be a driving source unique to the maintenance unit 50. However, this embodiment assumes a case in which the driving source that drives the conveying roller 31 is commonly used.

The unit driving mechanism 60 includes a gear device 61 to which the driving force is input, and a control member 62 that is driven by the input driving force.

The gear device 61 includes a clutch interlocked with the movement of the switching member 55. The clutch interrupts driving transmission between the gear device 61 and the control member 62. When the switching member 55 is located at the initial position, the gear device 61 does not transmit the input driving force to the control member 62. On the other hand, when the switching member 55 moves in the direction indicated by the arrow X1 to the position at which the carriage 11 is positioned at the position P1, the clutch is connected to transmit the input driving force to the control member 62.

The control member 62 is a plate-shaped movable member supported by the base member 54 to be freely displaced. In this embodiment, the control member 62 reciprocally moves in the Y direction. However, the control member 62 may be configured to pivot. In this embodiment, the control member 62 is a cam member including a plurality of cam portions, and causes the components of the maintenance unit 50 to operate by moving. When the plurality of cam portions are formed in the single control member 62, and the components are operated, the components can be operated synchronously, and the operation order can be controlled by the position of the control member 62.

Note that in this embodiment, the pump 53 is driven by a driving source different from the driving source of the maintenance unit 50 (the driving source that drives the conveying roller 31) so as to be independently drivable. The different driving source may be a unique driving source (for example, a motor), or may serve as another driving source (for example, a driving source that drives the feeding roller 21). The pump 53 can thus be driven independently of the operation of each component interlocked with the movement of the control member 62. The operation of each component according to the movement of the control member 62 will sequentially be described below.

<Wiper Driving Mechanism>

Figure 5:
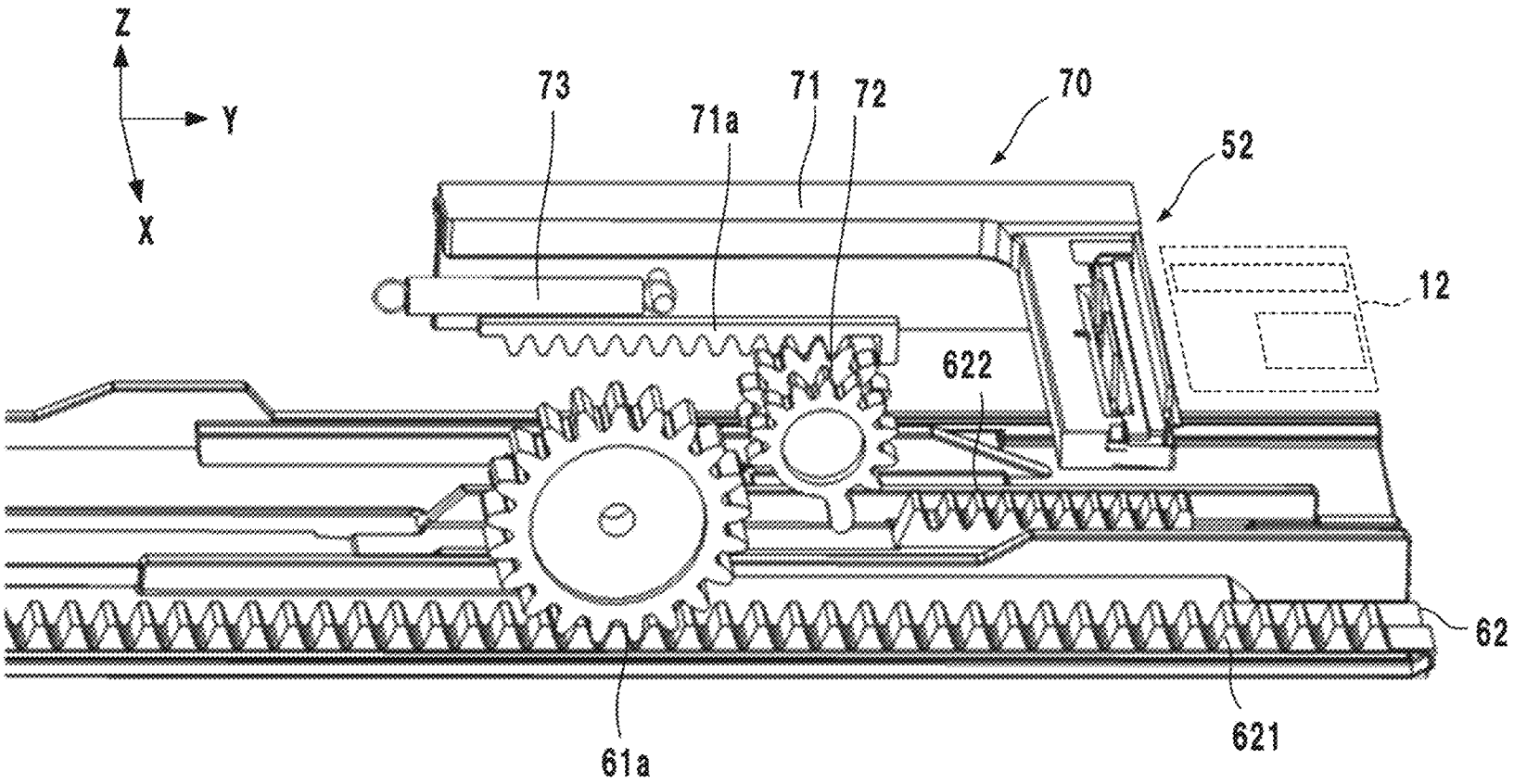
FIG. 5 is an explanatory view of a wiper driving mechanism.

The unit driving mechanism 60 includes a wiper driving mechanism 70 that drives the wiper 52. FIG. 5 is an explanatory view of the wiper driving mechanism 70. The control member 62 includes a rack 621 extending in the Y direction. A pinion 61*a* that constitutes the gear device 61 meshes with the rack 621. A driving force input to the gear device 61 is transmitted to the control member 62 via the pinion 61*a* to reciprocally move the control member 62 in the Y direction.

The wiper driving mechanism 70 includes a support member 71 that supports the wiper 52. A spring 73 is provided between the support member 71 and the frame 54. The support member 71 includes a rack 71*a* extending in the Y direction. One pinion of a double pinion 72 rotatably supported by the frame 54 meshes with the rack 71*a*. A rack 622 extending in the Y direction is formed on the control member 62. When the control member 62 is displaced to a predetermined position in the Y direction, the other pinion of the double pinion 72 meshes with the rack 622.

FIG. 5 shows a case in which the support member 71 is located at the initial position. The wiper 52 exists at a position apart in the Y direction from the printhead 12 located at the position P1. When the double pinion 72 and the rack 622 mesh with each other along with the movement of the control member 62 in one direction, the support member 71 moves in the Y direction, and the wiper 52 wipes the ink discharge surface of the printhead 12 located at the position P1 while moving across the surface in the Y direction. Then the control member 62 moves in the reverse direction, the support member 71 moves reversely in the Y direction, and the wiper 52 starts returning to the original position. When the double pinion 72 and the rack 622 are unmeshed, the support member 71 is returned to the initial position apart in the Y direction from the printhead 12 by the biasing of the spring 73.

<Cap Driving Mechanism>

Figure 6:
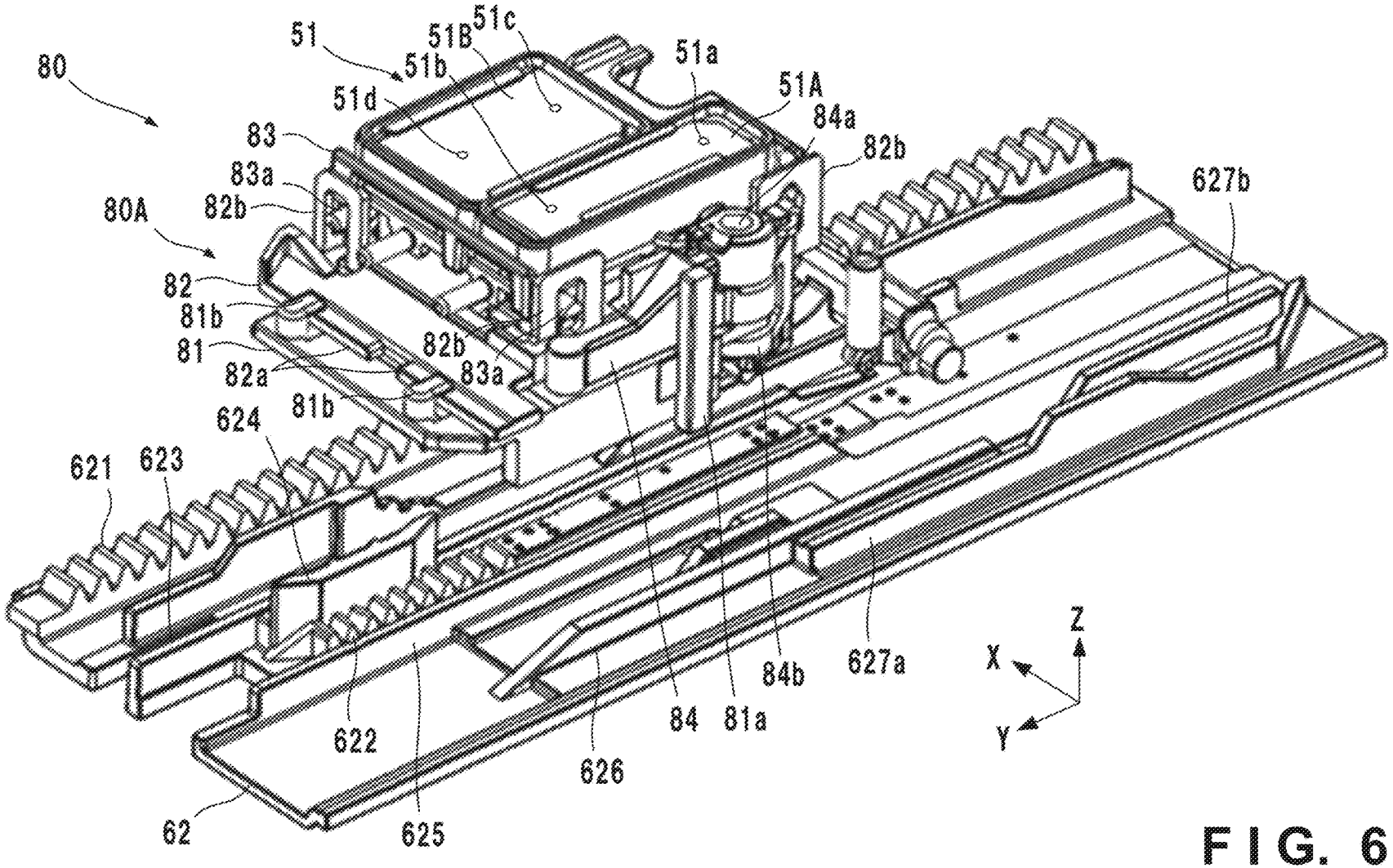
FIG. 6 is an explanatory view of a cap driving mechanism.

The unit driving mechanism 60 includes a cap driving mechanism 80 that drives the cap 51. FIG. 6 is an explanatory view of the cap driving mechanism 80. In this embodiment, the cap 51 can be displaced in the X and Z directions by the cap driving mechanism 80.

The unit driving mechanism 60 includes a support unit 80A on which the cap 51 is mounted. The support unit is formed by vertically stacking a cap base 81, a slider 82, and a support frame 83. The cap 51 is fixed to the support frame 83 of the uppermost portion. The cap base 81 is located in the lowermost portion, and the slider 82 is located between the cap base 81 and the support frame 83.

Figure 7A:
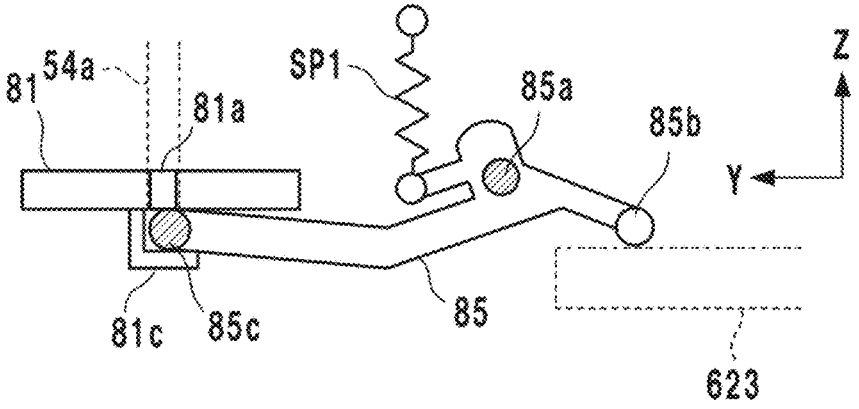
FIGS. 7A to 7C are explanatory views of a cap lifting mechanism.
Figure 7B:
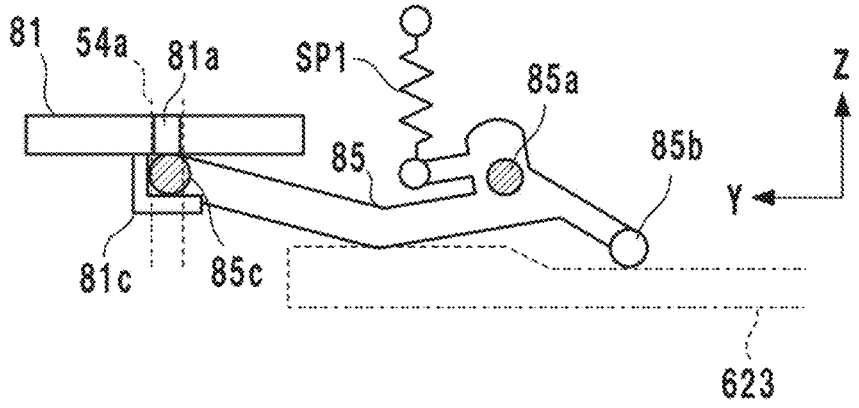
Figure 7C:
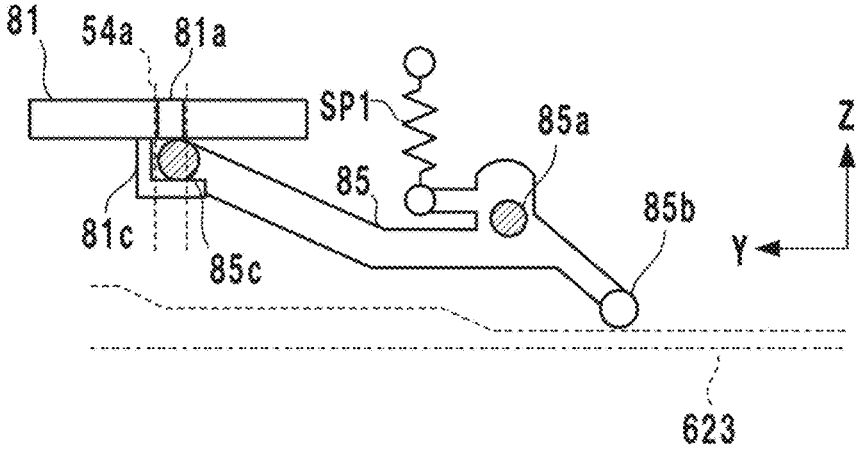

The cap base 81 is lifted in the Z direction by a cam portion 623 of the control member 62. FIGS. 7A to 7C are explanatory views of the mechanism and the operation. A description will be made with reference to these drawings as well. Prismatic slide portions 81*a* extending in the Z direction are provided on both sides of the cap base 81 in the X direction (each drawing shows only the slide portion 81*a* on one side). A Z-direction groove 54*a* that guides the slide portion 81*a* is formed in the base member 54. The cap base 81 can be displaced in the Z direction by the guide of the groove 54*a*.

An L-shaped engaging portion 81*c* is formed on the bottom proton of the cap base 81. One end 85*c* of a cap arm 85 engages with the engaging portion 81*c*. The cap arm 85 is supported by the base member 54 to freely pivot about an axis 85*a* serving as a pivot center. The end 85*c* is an axial portion and engages with the engaging portion 81*c* to be slightly displaced in the Y direction but not to be displaced in the Z direction.

The other end 85*b* of the cap arm 85 forms a cam follower that comes into slidable contact with the cam portion 623. A spring SP1 is provided between the cap arm 85 and the base member 54. The spring SP1 biases the cap arm 85 in a rising direction.

The cam portion 623 is formed to locate the cap base 81 at three positions in the Z direction. FIGS. 7A to 7C show cases in which the cap base 81 is located at a lower position, a middle position, and an upper position. When the control member 62 moves in the Y direction, the cap base 81 lifts, and therefore, the cap 51 is displaced in the Z direction. Note that in FIGS. 7A to 7C, the shape of the cam portion 623 is merely schematic, and the relationship between the lifting of the cap base 81 and the Y-direction movement of the control member 62 is not strictly represented.

The upper position is a position at which the printhead 12 located at the position P1 is capped with the cap 51. At the upper position, the cap 51 comes into tight contact with the printhead 12 and covers the ink discharge surface.

Figure 8A:
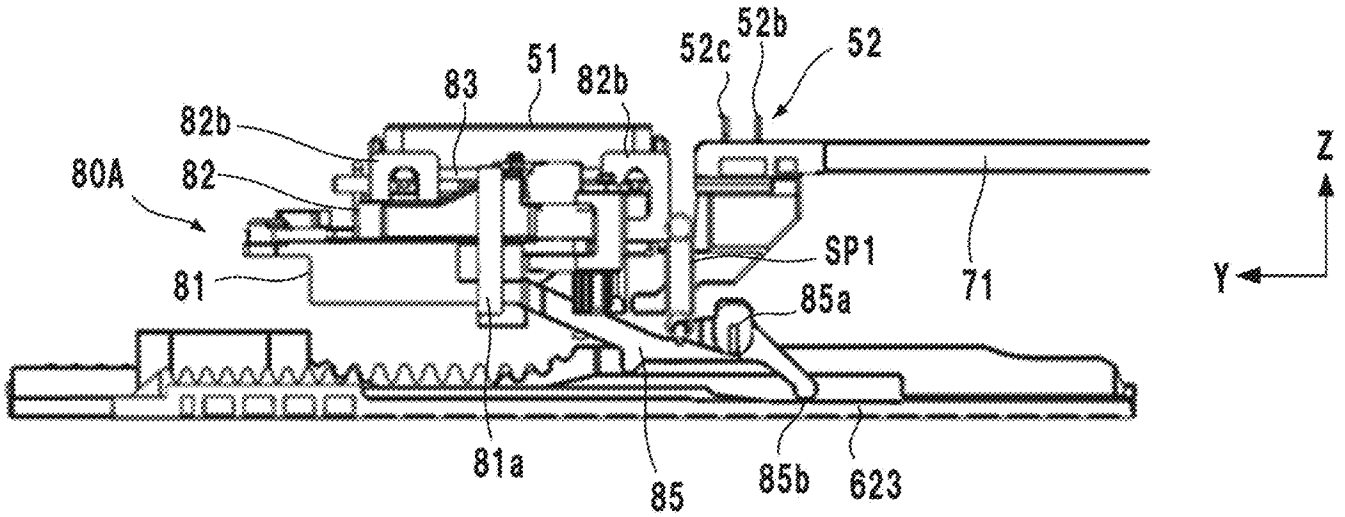
FIGS. 8A and 8B are explanatory views of a cap lifting operation.
Figure 8B:
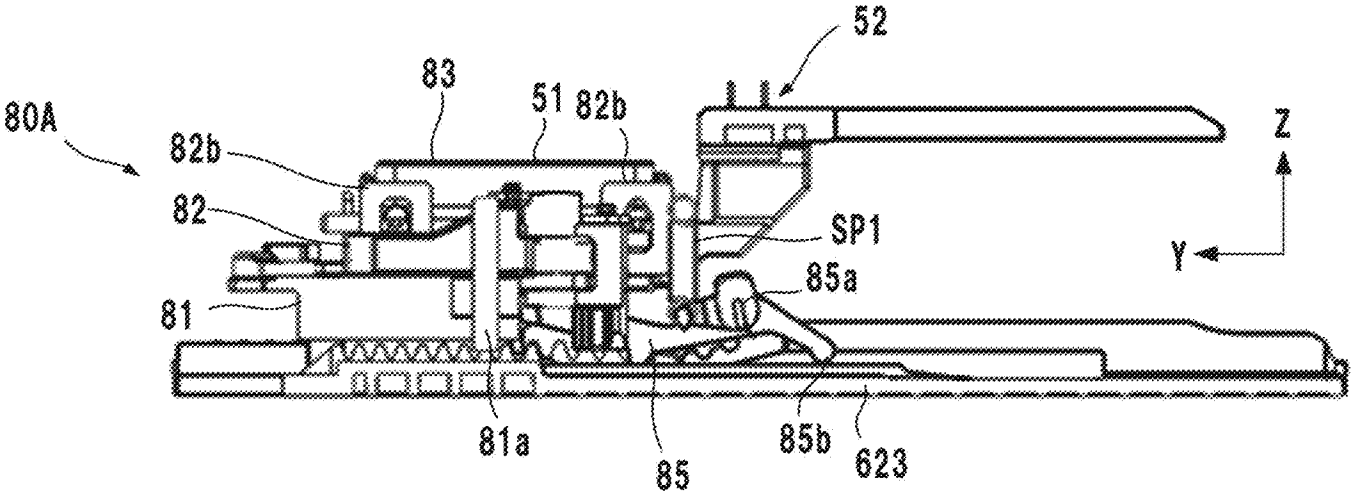

The middle position is a position at which the cap 51 separates downward from the printhead 12 located at the position P1 to the lower side. The lower position is a position at which the cap 51 further separates downward from the printhead 12 located at the position P1. According to the shape of the cam portion 623, the cap 51 is located at the lower position when performing wiping by the wiper 52. FIGS. 8A and 8B show the relationship between the Z-direction position of the cap 51 and the position of the wiper 52.

FIG. 8A shows a case in which the cap 51 is at the upper position. The cap 51 and the wiper 52 are located at almost the same position in the Z direction. FIG. 8B shows a case in which the cap 51 is at the lower position. The cap 51 is located at a position lower than the wiper 52. In wiping, the wiper 52 performs the wiping while passing through the space between the cap 51 at the lower position and the printhead 12 at the position P1.

In this embodiment, when the control member 62 moves from the moving start end to the moving termination end in the Y direction, the cam portion 623 displaces the cap 51 to the upper position→middle position→lower position. When the control member 62 returns from the moving termination end to the moving start end, the cap 51 is displaced to the lower position→middle position→upper position. The rack 622 that moves the wiper 52 is formed at a position to move the wiper 52 when the cap 51 is at the lower position.

Note that in this embodiment, the printhead 12 is capped by displacing the cap 51 in the Z direction. However, the side of the printhead 12 may be lifted. In this case, the arrangement for displacing the cap 51 in the Z direction is not essential.

Figure 9A:
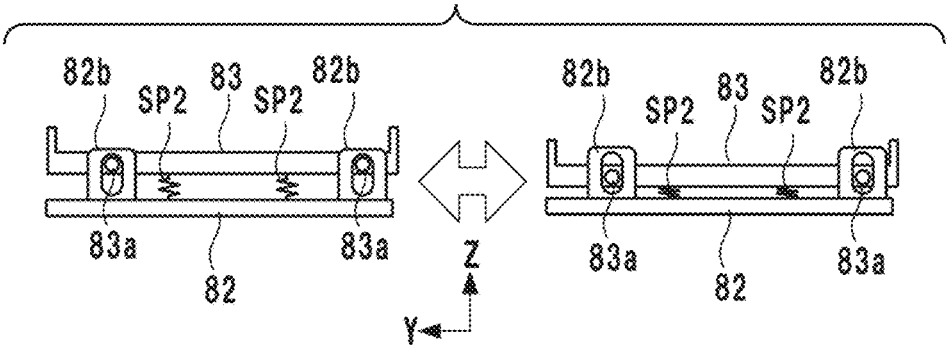
FIGS. 9A to 9C are explanatory views of the peripheral arrangement of the cap.

In this embodiment, a buffer mechanism capable of finely displacing the cap 51 in the Z direction is provided to bring the cap 51 into tight contact with the printhead 12 when capping the printhead 12 with the cap 51. FIG. 9A is an explanatory view of this.

A plurality of (for example, four) springs SP2 are provided between the slider 82 and the support frame 83. The slider 82 includes a plurality of engaging portions 82*b*, and the support frame 83 includes pins 83*a* that engage with the engaging portions 82*b*. Each engaging portion 82*b* has a slotted hole extending in the Z direction. The pin 83*a* projects from the support frame 83 in the horizontal direction and is inserted into the slotted hole.

The springs SP2 bias the slider 82 and the support frame 83 in a direction in which they are separated in the Z direction. By the engagement of the engaging portions 82*b* and the pins 83*a*, the support frame 83 is held by the slider 82 to be displaced in the Z direction. The cap 51 is fixed to the frame body 83 and can therefore be equalized with respect to the head discharge surface by the arrangement.

An arrangement that displaces the cap 51 in the X direction in the standby region R2 will be described with reference to FIGS. 6 and 9B to 10D.

A plurality of L-shaped engaging portions 81*b* are formed on both sides of the cap base 81 in the Y direction. Slide portions 82*a* that are in slidable contact with the engaging portions 81*b* so as to be guided in movement in the X direction are formed on both sides of the slider 82 in the Y direction (each drawing shows only the engaging portion 81*b* and the slide portion 82*a* on one side). With this arrangement, the slider 82 is supported by the cap base 81 to be displaced in the X direction. Hence, the cap 51 can be displaced in the X direction with respect to the cap base 81. In this embodiment, the slider 82 (that is, the cap 51) translates in the X direction. In other words, the displacement is possible without a capping operation.

Figure 9B:
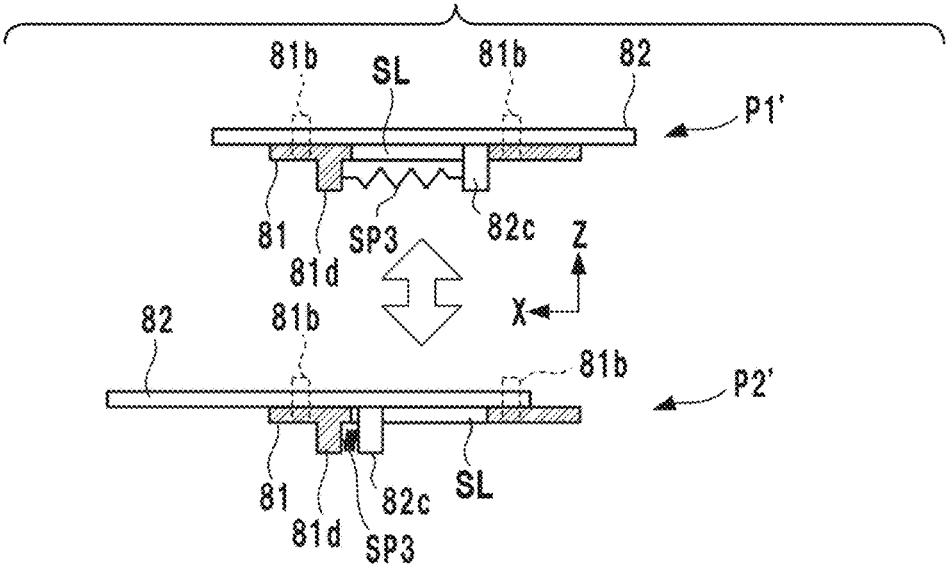

Mainly referring to FIG. 9B, a spring SP3 is provided between the cap base 81 and the slider 82. More specifically, a slit SL is formed in the cap base 81 so as to extend through the cap base 81 in the vertical direction. A support portion 82*c* extending to the lower side of the cap base 81 through the slit SL is formed on the slider 82. A support portion 81*d* separated from the support portion 82*c* in the X direction is formed on the bottom portion of the cap base 81. The spring SP3 is provided between the support portion 81*d* and the support portion 82*c*.

The form on the upper side of FIG. 9B represents a state in which the slider 82 is located at a position P1', and the form on the lower side represents a state in which the slider 82 is located at a position P2'. The position P1' is a position at which the cap 51 corresponds to the printhead 12 located at the position P1. The position P2' is a position at which the cap 51 corresponds to the printhead 12 located at the position P2. This position is closer to the printing region than the position P1'. The spring SP3 always biases the slider 82 to the side of the position P1.

A slide lever 84 and a cam portion 624 are components that displace the cap 51 to the position P2'. The slide lever 84 is a movable member that pivots about an axis 84*a* serving as a pivot center, and is pivotally supported by the cap base 81. The slide lever 84 is provided with a cam follower 84*b* provided to be coaxial with the axis 84*a*. The lever portion of the slide lever 84 is located on the upper side of the cap base 81, but the cam follower 84*b* is located on the lower side. The lever portion and the cam follower 84*b* may be integrally formed. Alternatively, they may be supported to pivot about the axis 84*a* and connected by a spring. This can give a cushioning effect by the spring to the pivot operation of the slide lever 84.

Figure 9C:
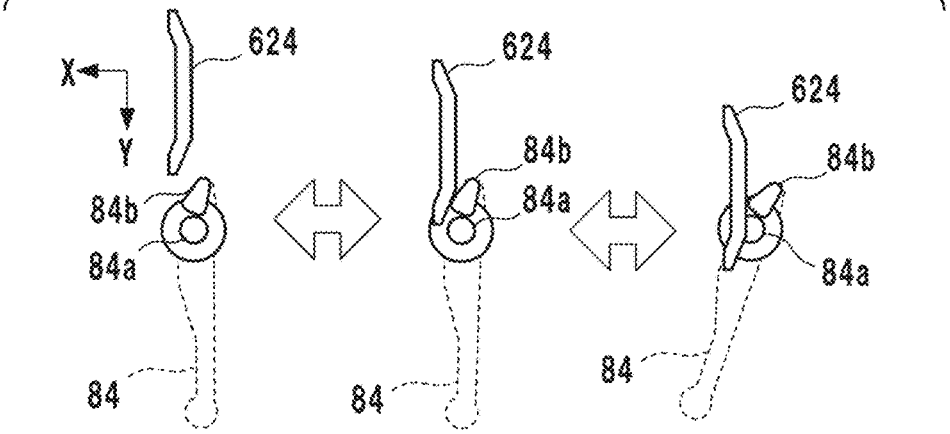

The slide lever 84 is arranged on a side of the slider 82 in the X direction. By making the slide lever 84 pivot, the slider 82 is pushed to the position P2. Pivot of the slide lever 84 is controlled by the cam portion 624 provided on the control member 62. FIG. 9C is an explanatory view of this. When the control member 62 moves in the Y direction, the cam portion 624 and the cam follower 84*b* come into slidable contact, and the slide lever 84 pivots clockwise in FIG. 9C while being guided by the cam portion 624. The slider 82 is pressed by the distal end of the slide lever 84 and displaced to the position P2'.

Figure 10A:
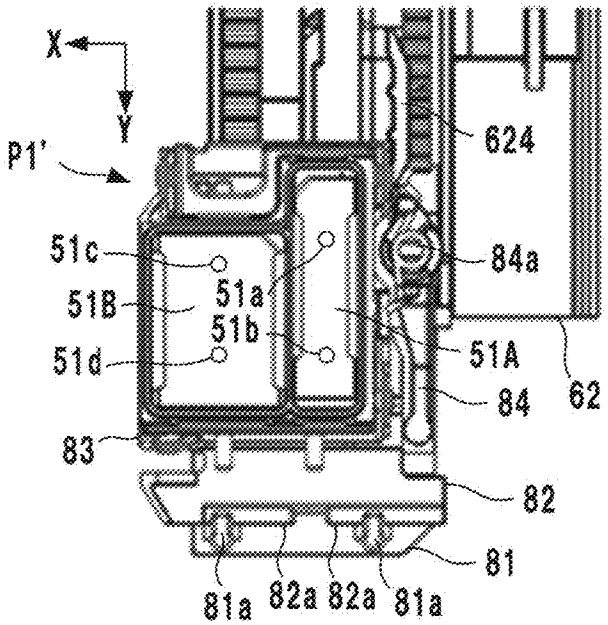
FIGS. 10A to 10D are explanatory views of the displacement of the cap.
Figure 10B:
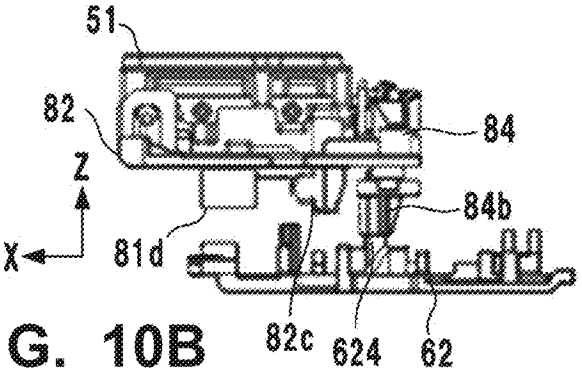
Figure 10C:
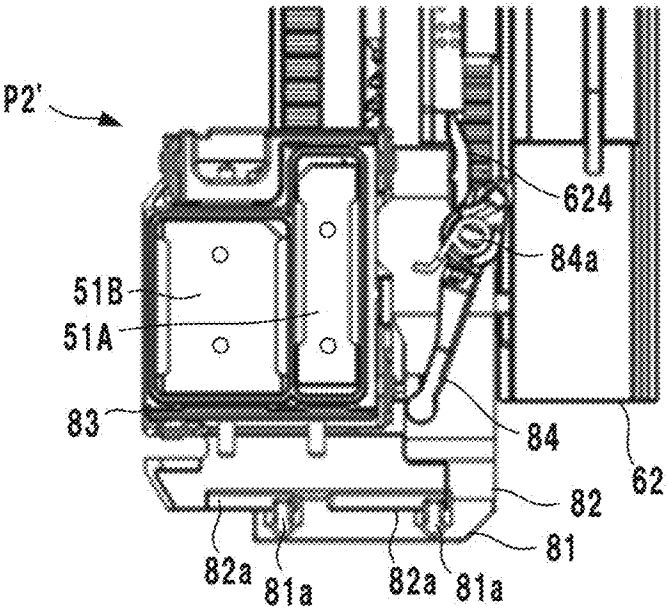
Figure 10D:
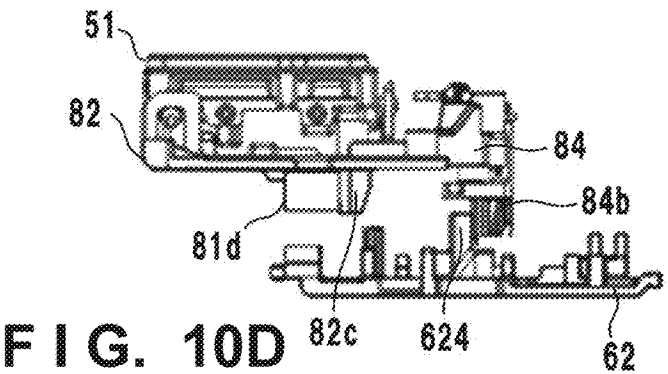

FIGS. 10A and 10B are a plan view and a front view, respectively, showing the arrangement on the periphery of the cap 51 in a case in which the cap is located at the position P1'. FIGS. 10C and 10D are a plan view and a front view, respectively, showing the arrangement on the periphery of the cap 51 in a case in which the cap is located at the position P2'. When the slide lever 84 pivots from the state shown in FIGS. 10A and 10B, a transition to the state shown in FIGS. 10C and 10D occurs. The cap base 81 is immovable, and the slider 82, the support frame 83, and the cap 51 are displaced in the X direction in the standby region R2.

In FIG. 9C, when the cam portion 624 passes the cam follower 84*b*, the slider 82 is returned to the position P1' by the biasing of the spring SP3. That is, the position of the cap 51 returns from the state shown in FIGS. 10C and 10D to the state shown in FIGS. 10A and 10B.

In this embodiment, when the control member 62 moves from the moving start end to the moving termination end in the Y direction, the cam portion 624 displaces the cap 51 to the position P1'→position P2'→position P1'. When the control member 62 returns from the moving termination end to the moving start end, the cap 51 is also displaced to the position P1'→position P2'→position P1'.

As for the relationship to the displacement of the cap 51 in the Z direction, the displacement of the cap 51 in the X direction is performed only at the middle position. Hence, when the control member 62 moves from the moving start end to the moving termination end in the Y direction, the cap 51 is displaced to the upper position (position P1')→middle position (position P1'→position P2'→position P1')→lower position (position P1'). When the control member 62 returns from the moving termination end to the moving start end, the displacement occurs in the reverse order.

In this embodiment, the cap 51 can be displaced between the position P1' and the position P2'. For example, when using the cap 51 for both preliminary discharge and cleaning of the printhead 12, a decrease in throughput can be suppressed. That is, the preliminary discharge of the printhead 12 is performed by locating the printhead 12 at the position P2 relatively close to the printing region R1 and locating the cap 51 at the corresponding position P2'. In a state in which the cap 51 is located at the middle position, ink is discharged from the printhead 12 to the cap 51. This makes it possible to perform preliminary discharge while shortening the moving distance of the printhead 12 (carriage 11) during the printing operation and suppress a decrease in the throughput of printing. Note that in this embodiment, the pump 53 is not driven to suck the discharged ink in preliminary discharge. However, the pump 53 may be driven to suck the ink in preliminary discharge.

On the other hand, the cleaning of the printhead 12 is performed by locating the printhead 12 at the position P1 relatively far from the printing region R1 and locating the cap 51 at the corresponding position P1'. The printhead 12 is capped with the cap 51, and the pump 53 is driven to do negative pressure suction of ink from the printhead 12. Thickened ink can thus be removed. In addition, the wiper 52 wipes the ink discharge surface of the printhead 12. Even if the ink scatters in capping cancel or wiping at the time of cleaning, the influence on the printing region R1 can be reduced because the printhead 12 is far apart from the printing region R1. In addition, since the cleaning can be performed at one position P1, the carriage need not move, and the cleaning time can be shortened, as compared to an arrangement that performs negative pressure suction of ink and wiping at different positions.

Note that in this embodiment, the cap 51 is displaced synchronously with the displacement of the control member 62. Since the cap 51 can be displaced without being restricted by the position of the carriage 11, this arrangement is advantageous as compared to an arrangement in which the cap 51 is pushed by the carriage 11 and displaced. Additionally, at the position P2', the cap 51 can be displaced to a plurality of positions in the Z direction. For this reason, not only negative pressure suction but also a cleaning operation other than the negative pressure suction such as wiping by the wiper 52 can be performed. In this embodiment, the cap 51 is displaced synchronously with the displacement of the control member 62 by the cam mechanism formed by the cam portions 623 and 624. However, the cap 51 may be displaced synchronously by a mechanism other than the cam mechanism.

<Carriage Lock Mechanism and Negative Pressure Charge Mechanism>

A positioning operation of the carriage 11 by the lock lever 56 and a negative pressure charge mechanism by the charge lever 58 will be described with reference to FIGS. 11A to 11D. FIGS. 11A to 11D are explanatory views of the mechanisms and operations of the lock lever 56 and the charge lever 58.

The charge lever 58 constitutes a charge mechanism configured to increase the suction force when negative pressure suction of ink from the printhead 12 is performed by the cap 51. The charge lever 58 closes/releases the flexible tubes that connect the pump 53 to the cap 51 (the opening portions 51*b* and 51*d*). One charge lever 58 may be provided in correspondence with the tubes. The charge levers 58 may be provided separately for the tubes. Alternatively, the charge lever 58 may be provided only for one of the tubes.

The charge lever 58 is a movable member supported by the base member 54 to freely pivot about an axis 58*a* serving as a pivot center. A pressing portion that presses a tube T1 is formed at one end 58*c* of the charge lever 58, and a cam follower that comes into slidable contact with a cam portion 626 formed on the control member 62 is formed at the other end 58*b*. A spring SP5 is provided between the side of the end 58*c* and the base member 54. The charge lever 58 also includes an engaging portion 58*d* that engages with the lock lever 56.

FIG. 11A shows a state in which the end 58*c* closes the tube T1. The tube T1 is a flexible tube that connects the pump 53 to the cap 51. The tube T1 is sandwiched between the end 58*c* and a guide 54*c* for the tube T1 formed on the base member 54 so that the tube T1 is flattened and closed at the midpoint. The spring SP5 biases the charge lever 58 to a closing position shown in FIG. 11A. An arrangement in which the end 58*b* serving as a cam follower does not come into slidable contact with the cam portion 626 (the cam portion 626 is absent) when locating the charge lever 58 at the closing position can also be employed.

FIG. 11B shows a state in which the end 58*c* releases the tube T1. The end 58*c* of the charge lever 58 is located at a releasing position far apart from the guide 54*c* as compared to the state shown in FIG. 11A, and the tube T1 is not sandwiched between the guide 54*c* and the end 58*c*.

The displacement (here, a pivotal movement) of the charge lever 58 is controlled by the shape of the cam portion 626 when the control member 62 moves in the Y direction. When performing negative pressure suction of the printhead 12 by the cap 51, the tube T1 is closed and then released, thereby instantaneously raising the negative pressure in the cap 51 and increasing the suction force.

The lock lever 56 is a movable member supported by the base member 54 to freely pivot about an axis 56*b* serving as a pivot center. An engaging portion that comes out of an upper surface 54*b* of the base member 54 and enters the engaging hole 11*a* of the carriage 11 is formed at one end 56*a* of the lock lever 56. A cam follower that comes into slidable contact with a cam portion 625 formed on the control member 62 is formed at the other end 56*c* of the lock lever 56. A spring SP4 is provided between the lock lever 56 and the base member 54. The lock lever 56 also includes an engaging portion 56*d* that engages with the charge lever 58.

FIGS. 11A and 11B show a state in which the end 56*a* comes out of the upper surface 54*b* and enters the engaging hole 11*a* to locate the carriage 11 at the position P1. During cleaning of the printhead 12, the lock lever 56 is located at a lock position shown in FIGS. 11A and 11B to position the carriage 11 at the position P1, thereby performing a more stable and correct cleaning operation. The spring SP4 biases the lock lever 56 to the lock position shown in FIGS. 11A and 11B. An arrangement in which the end 56*c* serving as a cam follower does not come into slidable contact with the cam portion 625 (the cam portion 625 is absent) when locating the lock lever 56 at the lock position can also be employed.

Figure 11D:
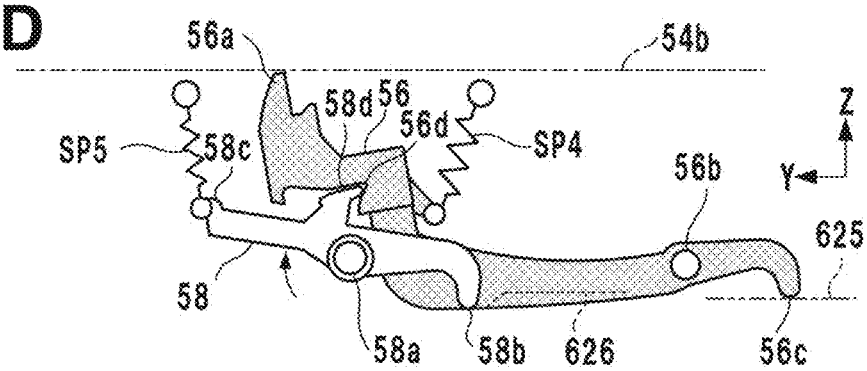

FIGS. 11C and 11D show a state in which the end 56*a* retreats to the lower side of the upper surface 54*b* to unlock the carriage 11. The carriage 11 can thus move from the position P1. The displacement (here, a pivotal movement) of the lock lever 56 is controlled by the shape of the cam portion 625 when the control member 62 moves in the Y direction.

The tube T1 is closed by the charge lever 58 only when performing negative pressure suction of ink from the printhead 12, that is, cleaning the printhead 12 at the position P1.

In this embodiment, the displacement of the charge lever 58 to the closing position is regulated by the lock lever 56. More specifically, the engaging portion 56*d* of the lock lever 56 at the unlock position and the engaging portion 58*d* of the charge lever 58 at the unlock position engage with each other, thereby preventing the charge lever 58 from mechanically pivoting to the closing position.

FIGS. 11C and 11D show an operation of engaging the engaging portion 56*d* with the engaging portion 58*d*. In FIG. 11C, both the lock lever 56 and the charge lever 58 are located at the unlock position. At this time, the engaging portion 56*d* and the engaging portion 58*d* are at positions close to each other.

When the control member 62 is moved in the Y direction from the state shown in FIG. 11C, the charge lever 58 is displaced slightly to the closing position side within the range of the unlock position by the action of the cam portion 626 and the spring SP5, as shown in FIG. 11D. Accordingly, the wedge-shaped engaging portion 58*d* enters the concave-shaped engaging portion 56*d* so that they engage with each other. Even if the charge lever 58 is to be displaced further to the closing position side, the displacement is regulated by the lock lever 56. Hence, the charge lever 58 is prevented from being unexpectedly displaced to the closing position.

In this embodiment, when the control member 62 moves from the moving start end to the moving termination end in the Y direction, the cam portions 625 and 626 displace the lock lever 56 to the lock position→unlock position. The cam portions 625 and 626 also displace the charge lever 58 to the closing position→unlock position (disengage→engage). When the control member 62 returns from the moving termination end to the moving start end, the operation reverses.

In this embodiment, the cam portion 626 has an arrangement in which the end 58*b* serving as a cam follower does not come into slidable contact with the cam portion 626 (the cam portion 626 is absent) when obtaining the engaged state shown in FIG. 11D. An arrangement in which the end 58*b* comes into slidable contact with the cam portion 626 (the cam portion 626 is present) can also be employed. However, the total length of the cam portion 626 can be shortened in the arrangement according to this embodiment. Hence, downsizing of the apparatus can be implemented by making the cam member 62 compact.

Note that in FIGS. 11A to 11D, the shapes of the cam portions 625 and 626 are merely schematic, and the relationship between the displacement of the lock lever 56 and the charge lever 58 and the Y-direction movement of the control member 62 is not strictly represented.

<Air Valve>

An air valve including the air valve lever 57 will be described with reference to FIGS. 12A and 12B. The air valve lever 57 closes/releases the flexible tubes connected to the cap 51 (the opening portions 51*a* and 51*c*). One air valve lever 57 is formed for each tube.

The air valve lever 57 is a movable member supported by the base member 54 to freely pivot about an axis 57*a* serving as a pivot center. A tube T2 for atmosphere communication connected to the cap 51 is connected to one end 57*c* of the air valve lever 57. As shown in FIG. 6, cam portions 627*a* and 627*b* corresponding to each air valve lever 57 are formed on the control member 62. If the cam portions 627*a* and 627*b* are not discriminated, they are expressed as cam portions 627. This also applies to FIGS. 12A and 12B. A cam follower that comes into slidable contact with the cam portion 627 formed on the control member 62 is formed at the other end 57*b* of each air valve lever 57. A spring SP6 is provided between the air valve lever 57 and the base member 54.

Figure 12A:
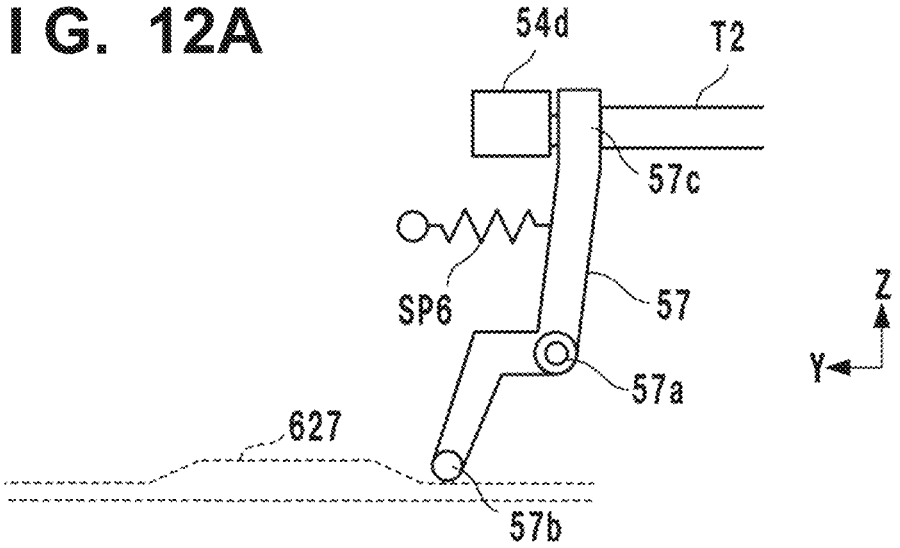
FIGS. 12A and 12B are explanatory views of an air valve.
Figure 12B:
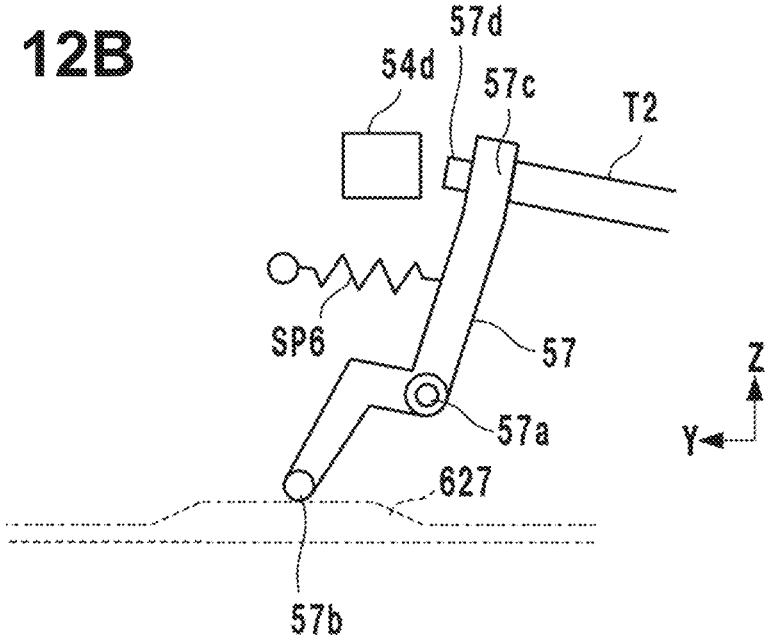

FIG. 12A shows the closed state of the tube T2, and FIG. 12B shows the released state of the tube T2. The end 57*c* has a pipe portion 57*d* communicating with the tube T2. In the closed state shown in FIG. 12A, the air valve lever 57 is located at the closing position, and the pipe portion 57*d* is inserted into a closing portion 54*d* of the base member 54, thereby closing the tube T2. In the released state shown in FIG. 12B, the air valve lever 57 is located at the releasing position, and the pipe portion 57*d* is separated from the closing portion 54*d*, thereby releasing the tube T2.

If the tube T2 is in the released state, the interior of the cap 51 is released to the atmosphere. If the tube T2 is in the closed state, the interior of the cap 51 is tightly closed. The spring SP6 biases the air valve lever 57 to the closing position shown in FIG. 12A. An arrangement in which the end 57*b* serving as a cam follower does not come into slidable contact with the cam portion 627 (the cam portion 627 is absent) when locating the air valve lever 57 at the closing position can also be employed.

The displacement (here, a pivotal movement) of the air valve lever 57 is controlled by the shape of the cam portion 627 when the control member 62 moves in the Y direction.

Immediately after the printhead 12 is capped with the cap 51, and negative pressure suction of ink is performed, the ink remains in the cap 51. If the cap 51 is separated from the printhead 12 in this state, the ink may scatter or excessively adhere to the ink discharge surface, resulting in poor maintenance properties. To prevent this, after negative pressure suction of ink is performed, and before the cap 51 is separated from the printhead 12, the air valve lever 57 is displaced to the releasing position to release the interior of the cap 51 to the atmosphere, and driving of the pump 53 is continued. The ink remaining in the cap 51 can thus be sucked without sucking the ink from the printhead 12.

Note that in FIGS. 12A and 12B, the shape of the cam portion 627 is merely schematic, and the relationship between the displacement of the air valve lever 57 and the Y-direction movement of the control member 62 is not strictly represented.

<Control Unit>

Figure 13:
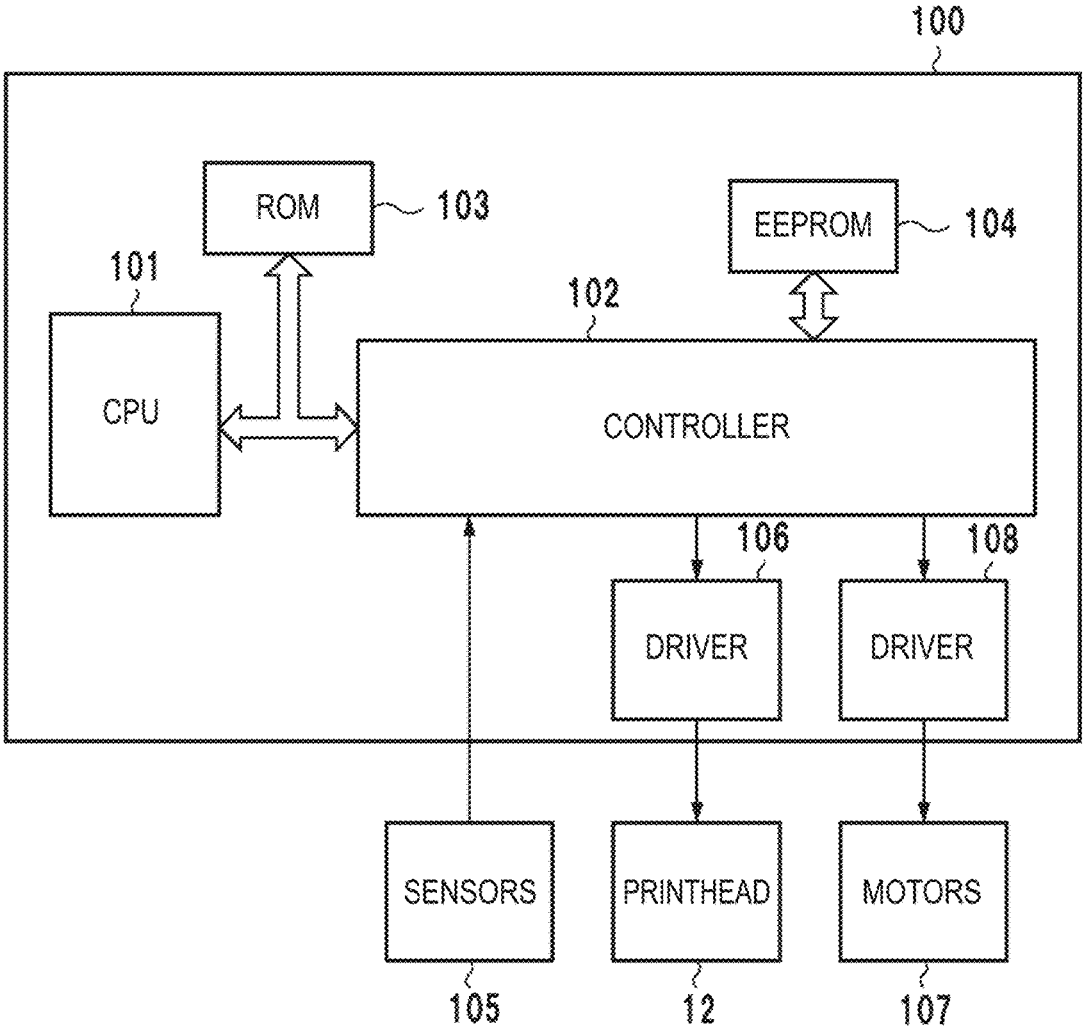
FIG. 13 is a block diagram of a control unit.

The arrangement of the control system of the printing apparatus 1 will be described with reference to FIG. 13. FIG. 13 is a block diagram of a control unit 100 that controls the printing apparatus 1. The control unit 100 is a control circuit that controls the operation of each mechanical unit of the printing apparatus 1. A CPU 101 controls the entire printing apparatus 1. A controller 102 assists the CPU 101 and controls driving of various motors 107 and the printhead 12 in accordance with detection results of various sensors 105.

Various kinds of data and the control program of the CPU 101 are stored in a ROM 103. Various kinds of data are stored in an EEPROM 104. Note that as the ROM 103 and the EEPROM 104, other storage devices may be employed.

A driver 108 drives the various motors 107. The various motors 107 include, for example, motors serving as the driving source of the conveyance mechanism (the feeding unit 20, the conveying unit 30, and the discharge unit 40), a motor serving as the driving source of the driving mechanism of the carriage 11, and a motor serving as the driving source of the pump 53. A driver 106 drives the printhead 12. The various sensors 105 include a sensor that detects the position of the carriage 11, and a sensor disposed in the conveyance path of the printing medium to detect the printing medium.

A printing operation starts when, for example, a print job is received from a host computer, or a print job to print an original read by the scanner unit 3 on a printing medium is generated. For example, the following control examples will be mentioned as the printing operation by the control unit 100 and the performance maintaining operation for the printhead 12.

In the initial state, the cap 51 is arranged at the position P1', and the printhead 12 is arranged at the position P1. Immediately before execution of a print job, cleaning of the printhead 12 (capping by the cap 51, negative pressure suction, and wiping) is performed. After that, the cap 51 is moved to the position P2'. The feeding unit 20 feeds a printing medium.

A printing operation of alternately performing conveyance of the printing medium by the conveying unit 30 and print scanning of the printhead 12 is executed. Every time print scanning of the printhead 12 is performed one or a plurality of times, the printhead 12 is moved to the position P2, and preliminary discharge is performed. These processes are repeated, thereby ending image printing on the printing medium.

After that, the discharge unit 40 discharges the printing medium.

If a next page exists, the printhead 12 is cleaned as need, and the same procedure as described above is repeated.

(Another Example of Cap Position)

In the embodiment, an example in which the cap 51 is displaced to three positions, that is, the lower position, the middle position, and the upper position in the Z direction has been described. However, the cap 51 may be configured to be displaced to two positions, that is, the lower position and the upper position in the Z direction. In this case, the displacement between the position P1' and the position P2' may be performed at the lower position. Preliminary discharge may be done when the cap 51 is at the position P2'. Wiping may be done when the cap 51 is at the position P1' and the lower position.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2016-151523, filed Aug. 1, 2016, which is hereby incorporated by reference herein in its entirety.

What is claimed is:

1. A printing apparatus comprising:

a carriage on which a printhead, which is configured to discharge ink, is mounted, the carriage being configured to move in a first direction such that the printhead moves across a printing region where a printing operation by the printhead is performed and a standby region adjacent to the printing region in the first direction;

a cap arranged in the standby region and configured to cap the printhead, a wiper configured to perform wiping for the printhead, a first moving mechanism configured to move the cap in a gravity direction to an upper first position where the cap caps the printhead, a lower first position which allows the wiper to wipe the printhead, and a middle first position between the upper first position and the lower first position; and a second moving mechanism configured to move the cap to the middle first position and a second position, which is located nearer to the printing region than the middle first position and allows the printhead to perform preliminary discharge to the cap.

2. The apparatus according to claim 1, wherein the first moving mechanism includes a driving unit, a cam member configured to be displaced by a driving force from the driving unit, and a cap base configured to (i) support the cap and (ii) move in the gravity direction according to a displacement of the cam member.

3. The apparatus according to claim 2, wherein the cam member includes:

a first cam portion configured to displace the cap in the first direction; and a second cam portion configured to displace the cap in a second direction crossing the first direction and the gravity direction.

4. The apparatus according to claim 3, further comprising a first movable member configured to be displaced between a closing position to close a tube configured to connect the cap and a pump and a releasing position, wherein the cam member includes a third cam portion configured to displace the first movable member between the closing position and the releasing position.

5. The apparatus according to claim 4, further comprising a second movable member configured to be displaced between a lock position to lock the carriage at a predetermined position in the standby region and an unlock position, wherein the cam member includes a fourth cam portion configured to displace the second movable member between the lock position and the unlock position.

6. The apparatus according to claim 4, wherein the pump and the driving unit use different driving sources.

7. The apparatus according to claim 5, wherein the second movable member at the unlock position abuts against the first movable member located at the releasing position and regulates the displacement of the first movable member to the closing position.

8. The apparatus according to claim 3, further comprising a third movable member configured to be displaced between a closing position to close a tube for atmosphere communication connected to the cap and a releasing position, wherein the cam member includes a fourth cam portion configured to displace the third movable member between the closing position and the releasing position.

9. The apparatus according to claim 2, wherein the second moving mechanism includes the driving unit, the cam member and a slider configured to move in the first direction with regard to the cap base according to a displacement of the cam member.

10. The apparatus according to claim 2, wherein the cam member is displaced by the driving force in a second direction crossing the first direction and the gravity direction.

11. The apparatus according to claim 1, wherein the wiper wipes the printhead by passing through a space between the cap at the first lower position and the printhead.

* * * * *